US009290368B2

(12) United States Patent
Miller

(10) Patent No.: US 9,290,368 B2
(45) Date of Patent: Mar. 22, 2016

(54) METAL POSITIONING DEVICE

(71) Applicant: Jack Miller, Lucedale, MS (US)

(72) Inventor: Jack Miller, Lucedale, MS (US)

( * ) Notice: Subject to any disclaimer, the term of this patent is extended or adjusted under 35 U.S.C. 154(b) by 279 days.

(21) Appl. No.: 13/886,450

(22) Filed: May 3, 2013

(65) Prior Publication Data

US 2014/0326933 A1 Nov. 6, 2014

(51) Int. Cl.
*B66F 3/00* (2006.01)
*B66F 15/00* (2006.01)
*B66F 1/00* (2006.01)

(52) U.S. Cl.
CPC .. *B66F 15/00* (2013.01); *B66F 1/00* (2013.01)

(58) Field of Classification Search
USPC ..... 254/131
See application file for complete search history.

(56) References Cited

U.S. PATENT DOCUMENTS 427,544 A * 5/1890 Blakeslee ..... C14B 1/26 227/12
2,882,642 A * 4/1959 Hill ..... A47G 27/0493 254/200
3,257,018 A * 6/1966 Miles ..... B62B 1/06 254/131
3,599,936 A * 8/1971 Crain, Jr. ..... A47G 27/0493 254/212
3,651,305 A * 3/1972 Shimota ..... B29C 65/18 156/579
3,784,078 A * 1/1974 Escoe ..... A47G 27/0493 227/13
3,972,768 A * 8/1976 Hill ..... A47G 27/0443 156/201
4,230,302 A * 10/1980 Crain, Jr. ..... A47G 27/0493 254/212
4,286,383 A * 9/1981 Farden ..... E04G 23/006 15/93.1
4,792,120 A * 12/1988 Egaas ..... E02D 9/02 254/131
5,681,031 A * 10/1997 Foley ..... A47G 27/0493 254/209
5,775,673 A * 7/1998 Carnes, Sr. ..... B25B 25/00 254/120
D429,611 S * 8/2000 Hobaica ..... D8/15
6,154,917 A * 12/2000 Zahuranec ..... A47L 5/32 15/320
D439,380 S * 3/2001 Medema ..... D32/22
D470,982 S * 2/2003 Zahuranec ..... D32/32
6,994,323 B2 * 2/2006 Carbajal ..... A47G 27/0493 254/200
2003/0115760 A1 * 6/2003 Martinez ..... B26B 29/06 30/294
2007/0215848 A1 * 9/2007 Gaudreault ..... B60P 7/0853 254/131

* cited by examiner

*Primary Examiner* — Lee D Wilson
*Assistant Examiner* — Alvin Grant
(74) *Attorney, Agent, or Firm* — AdamsIP, LLC; J. Hunter Adams

(57) ABSTRACT

The invention discloses a metal positioning device. The device comprises a bottom section with a front end having a downward facing lip, a second back end having a handle, a side wall on both sides of said bottom section, said side walls running the length of the bottom section and a plurality of apertures formed along a longitudinal axis of said bottom section, said apertures being dimensioned to receive and allow passage of a lever bar therethrough. The invention further discloses a method of using the metal positioning device. The invention decreases the time needed to position metal sheets and eases the job for workers.

12 Claims, 5 Drawing Sheets

METAL POSITIONING DEVICE

FIELD OF THE INVENTION

A preferred embodiment of the invention refers to a metal positioning device, especially relating to container fabrication from metal sheets. In one embodiment, the invention further relates to a method of using the metal positioning device.

BACKGROUND OF THE INVENTION

Industrial and commercial storage tanks facilitate trade and are an integral part of modern commerce. From water processing and dry commodities to oil and frac sand, storage tanks are an essential component of a variety of industries. Yet despite the widespread use and impact of storage tanks, tank production remains much the same as it was 100 years ago. Sheets are cut from steel plates of varying thickness and manipulated to match the desired tank dimensions.

One of the first steps in building a storage tank is to properly position the metal panels that will be welded together to form the tank itself. The metal panels are often large, heavy steel sheets that are moved into place by a crane. While the metal sheet is still attached to the crane, workers help guide the sheet into the proper location so that the metal sheets may be welded together. To stay on schedule, workers must position the metal sheets quickly so that the crane can lift more metal sheets to be laid in position. Because most tank building takes place outdoors, workers are subjected to nature's elements. Wind, rain, and other weather conditions make the positioning of metal sheets difficult and unsafe. For example, high winds often cause metal sheets suspended from a crane to sway. Additionally, heavy rain can cause the workers' tools to slip.

Even in good weather, the metal panel will rarely be correctly positioned after it is released from the crane. Workers must therefore exert great force and strength to move the panels into place. Workers currently use various types of crowbars to align the large steel panels. This process is extremely labor intensive and time consuming. It requires workers to bend down and exert great amounts of pressure on their backs, legs, and arms as they push and pry the metal sheets. In inclement weather, the task of moving the large metal sheets becomes even more difficult because the crowbars are slippery.

Crowbars are the most common method of metal plate alignment in the storage tank industry. Dowel pins, or locating pins, provide another method of plate alignment. The pins are strategically placed so two pieces of sheet metal are aligned properly until they are welded or bolted together. After the tank is assembled, the dowel pins are removed and the holes are sealed with a weld. Although dowel pins are useful for more exact metal sheet positioning, workers still must use crowbars or similar methods to position the metal in place before inserting the dowel pins. Furthermore, the dowel pins must be removed and the holes welded over before the tank is finished. Additionally, the weight of the large metal sheets may bend or break the dowel pins. Dowel rods thus slow the process of tank building, and the dowel rods themselves are useful only for holding the sheets together, not for positioning the sheets in place.

Embodiments of the invention will not be limited to storage tank production. A version of the invention will generally find utility in any application that requires incremental positioning. One embodiment of the invention is aimed at incrementally moving large and heavy pieces of metal, and a version of the invention may be utilized in many applications in which the incremental positioning of metal is desired. Such applications include, but are not limited to, ship and vessel building, defense building applications, aerospace and airplane construction, and the like. In all industries, the current method of metal positioning is based on the highly labor intensive use of crow and pry bars.

Thus, a need exists in the art for a device that eases the process of positioning large metal sheets. Furthermore, a device that utilizes tools already in use is preferred, and, as in all fields, advancements in the art are desired.

SUMMARY OF THE INVENTION

The present invention is directed to a metal positioning device. The metal positioning device is comprised of a bottom section with a first front end having a downward facing lip. In a preferred embodiment, the downward facing lip is used to grip the lower sheet of metal as the upper piece of metal is positioned into place. In a preferred embodiment, the metal positioning device comprises a second back end having a handle. This handle allows the metal positioning device to be moved with ease. In a preferred embodiment, the metal positioning device has sidewalls on both sides of the bottom section. The sidewalls provide separation between the lower piece of metal and the upper piece of metal. In a preferred embodiment of the invention, the flat bottom section comprises a plurality of apertures. The apertures run the length of the bottom base member and are dimensioned to receive and allow passage of a lever bar there through.

DESCRIPTION OF THE DRAWINGS

These and other features, aspects, and advantages of the present invention will become better understood with regard to the following description, appended claims, and accompanying drawing where:

DETAILED DESCRIPTION OF THE INVENTION

Figure 1:
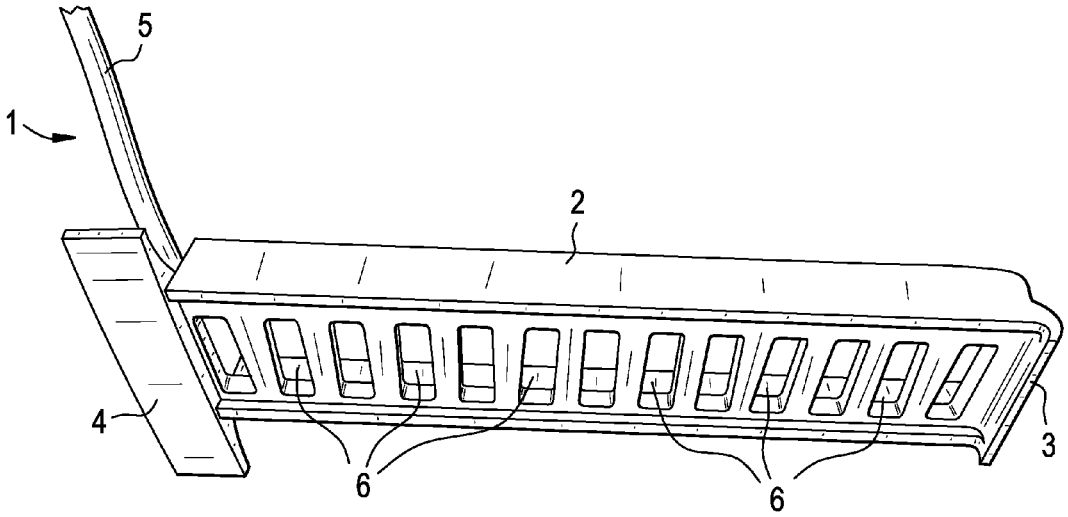
FIG. 1 depicts a perspective view of the metal positioning device provided in accordance with the teachings of the present invention.
Figure 2:
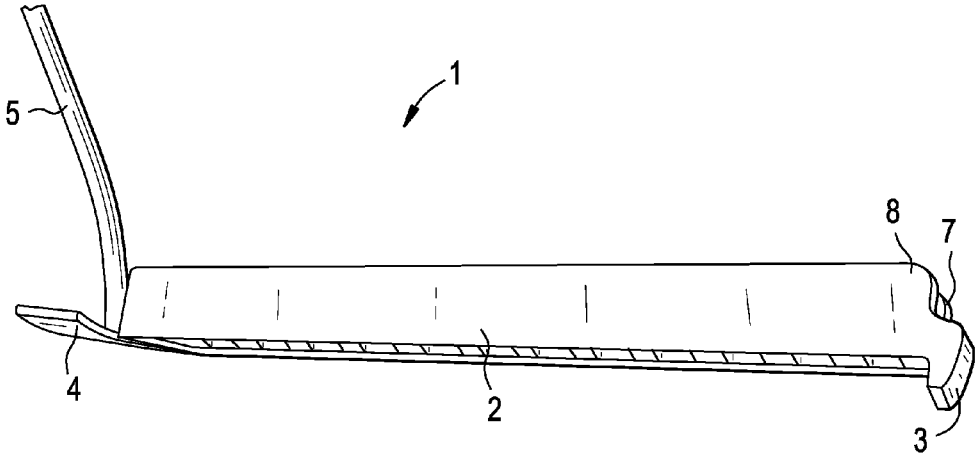
FIG. 2 shows another perspective view of the metal positioning device provided in accordance with the teachings of the present invention.
Figure 3:
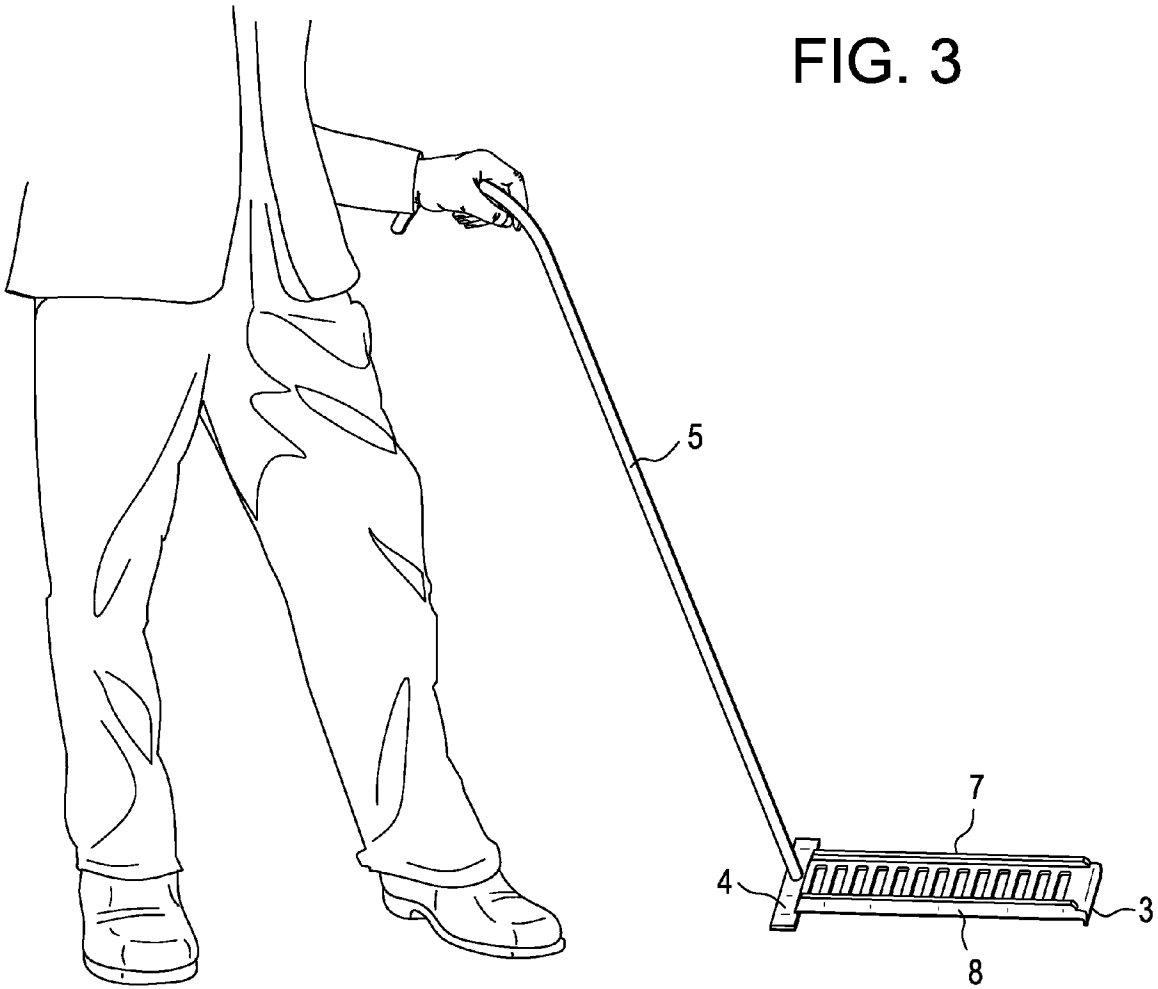
FIG. 3 shows a perspective view of the device being held by a user.

The present invention is directed to a metal positioning device. With reference to the drawings, and particularly FIGS. 1, 2, and 3, a version of the metal positioning device 1 is made of a body section 2 with a rear heel end 4 and front toe end 3. As shown in FIG. 3, a version of the invention includes a heel section 4 that extends outside of the edges of the left side 7 and right side 8 ridges of the upper side of the body section 2. Said heel section extending outside of the upper body section provides increased surface area for supporting the heel section. In another embodiment, said heel section 4 does not extent outside of the body section 2. Said embodiment with said heel section not extending outside of the body section may be used in tighter spaces.

As shown in FIGS. 1 and 2, extending from the rear heel 4 is a handle 5. In a preferred embodiment, the handle 5 is made of a hardened steel material. The handle 5 may also be made of any other material, both synthetic and natural. The version of the invention pictured in FIG. 3 shows a simple handle piece. However, it is understood that in other embodiments of the invention the handle 5 may be collapsible and/or removable. In yet other embodiments of the invention, the handle 5 may include a grip section.

Figure 4:
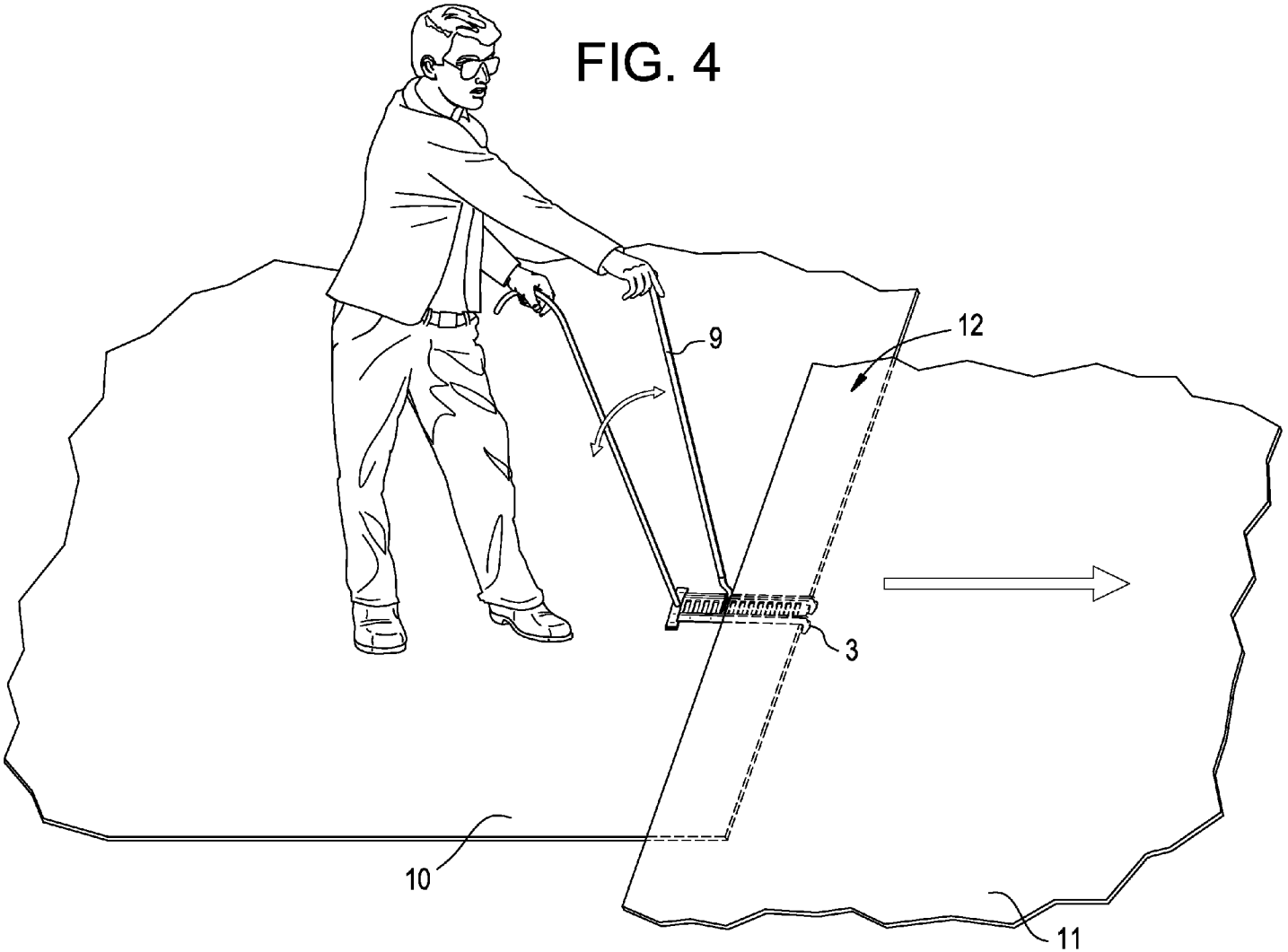
FIG. 4 and FIG. 5 show a typical use of the metal positioning device for positioning metal sheets.

As shown in FIG. 2 and FIG. 3, the body section 2 includes a left side 7 and right side 8. The left side 7 and right side 8 include ridges on the upper side of the body section 2. As shown in FIGS. 3 and 4, the ridges 7 and 8 provide extra space for separating the two pieces of metal 10 and 11. As illustrated in FIG. 3 and FIG. 4, above the ridges 7 and 8 is an open top. During use, the open top allows a user to access the apertures 6. It is understood that the ridges 7 and 8 may be altered to include a slope and/or steps. In addition, the ridges 7 and 8 may be increased or decreased in height based on the specific end use.

As noted in FIG. 1, the body section 2 includes apertures, or cavities, 6 extending longitudinally from said heel section 4 to said toe section 3. In one embodiment, as shown in FIG. 1, the apertures 6 are evenly spaced. In another version of the invention, the apertures may have uneven spaces. For example, in one embodiment, the spaces closer to the heel section 4 will be farther apart, and the apertures closer to the toe section 3 will be closer together. This embodiment will allow for more fine-tuned adjustments at the end section near the toe 3, and larger apertures at the heel end 4 for moving the piece into place more expeditiously.

Figure 5:
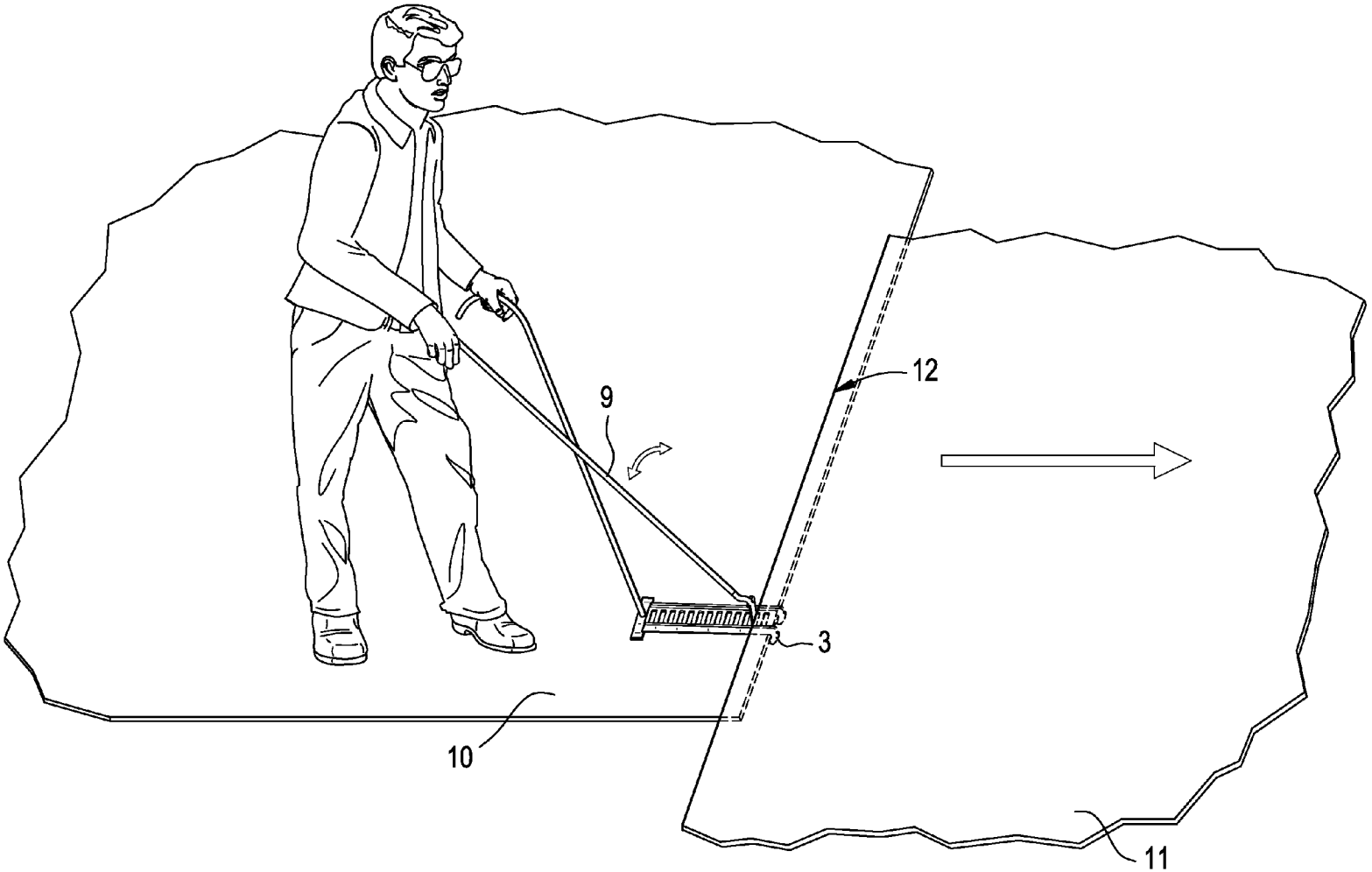

The end of the toe section 3 includes a lip portion 3 that extends downward, opposite the direction of the handle, as shown in FIG. 2. In a preferred embodiment, as shown in FIG. 2, the lip portion 3 includes a flat section on the side facing the apertures 6 and heel section 4. Said flat section of the lip portion 3 is intended to be flush with the lower piece of metal 10, thus providing an anchor point for pushing the upper metal piece 11 into place, as shown in FIG. 4 and FIG. 5. In yet another embodiment of the invention, the lip portion 3 that extends downward, opposite the direction of the handle 5, includes a curved side. Said curved side is advantageous if the lower material 10 includes a curved side. Other versions of the invention include a lip portion 3 that extends downward, opposite the direction of the handle 5, to substantially cover the end of the lower piece of metal, thus providing additional grip on taller pieces of metal.

In a preferred embodiment, the metal positioning device 1 is constructed with hardened metal, such as steel. However, said metal positioning device can be constructed from any material, including, but not limited to, natural and synthetic materials.

As shown in FIG. 4, the metal positioning apparatus 1 is used in conjunction with some type of lever bar 9. In a preferred embodiment, the lever bar 9 is a pry bar or crowbar. The user pulls the lip portion 3 of the device 1 flush with the end of the lower piece of steel 10. The user inserts a lever bar 9 into an aperture 6 and pushes the lever away from the user's body, thus pushing the upper metal piece 11 away from the user. As shown in FIG. 5, the user continues the step of inserting the lever bar into an aperture and pushing the lever bar away from the user, thus creating an overlap 12 between the upper 11 and bottom 10 pieces of metal.

Figure 6:
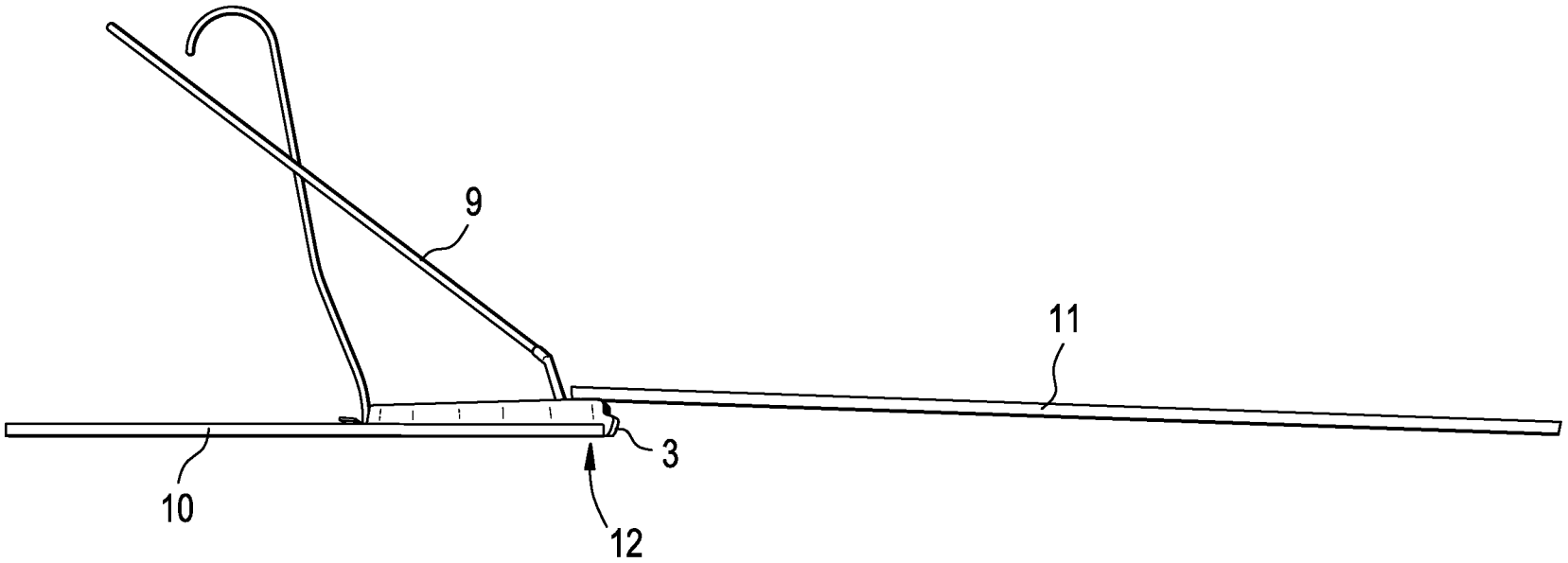
FIG. 6 depicts a front perspective view of the metal positioning device separating two metal plates for positioning.

As shown in FIG. 6, the device creates an overlap 12 between the two pieces of metal 10 11 allowing for precise welding. In other versions of the invention, the device creates an overlap 12 between the two pieces of material for joining by any other means. The metal positioning device 1 can be removed from the side of the sheets, thus leaving the upper and lower sheets perfectly aligned.

In addition to tank building, embodiments of the invention will have application in many different fields. Generally, a version of the invention will find utility in any application that requires incremental positioning. One embodiment of the invention is aimed at incrementally moving large and heavy pieces of metal. While tank building is one application in which a version of the invention may be used, it is understood that a version of the invention may be utilized in many applications in which the incremental positioning of metal is desired. Such applications may include, but are not limited to, ship and vessel building, defense building applications, aerospace and airplane manufacturing, and the like.

What is claimed is:

1. A material positioning device, the device comprising:
- a bottom section with a first front end having a downward facing lip,
- a back end having a handle,
- a sidewall on both sides of said bottom section,
- an open top, and
- a plurality of apertures formed along a longitudinal axis of said bottom section,
- wherein said apertures are dimensioned to receive and allow passage of a lever bar therethrough.

2. A metal positioning device, the device comprising:
- a bottom section with a front end having a downward facing lip,
- a back end having a handle,
- a sidewall on both sides of said bottom section,
- an open top, and
- a plurality of apertures formed along a longitudinal axis of said bottom section,
- wherein said apertures are dimensioned to receive and allow passage of a lever bar therethrough.

3. A metal positioning device set forth in claim 2, wherein said handle is removable.

4. A metal positioning device set forth in claim 2, wherein said handle is extendable.

5. A metal positioning device in as set forth in claim 2, wherein said apertures are evenly spaced.

6. A metal positioning device in as set forth in claim 2, wherein said apertures are not evenly spaced.

7. A metal positioning device as set forth in claim 2, wherein said downward facing lip includes a flat side.

8. A metal positioning device as set forth in claim 2, wherein said downward facing lip includes a curved side.

9. A method for positioning pieces of material using the device set forth in claim 1, comprising:
- providing a upper and a lower piece of material,
- positioning the device between said upper and said lower piece of material;
- positioning the downward facing lip of the device flush against an end section of the lower material,
- positioning the upper piece of material atop the device,
- positioning a bar into an aperture of the device,
- pushing the bar away from a user's body,
- reinserting the bar into an aperture and pushing the bar away from the user's body, and
- removing the positioning device.

10. A method for positioning pieces of metal using the device set forth in claim 2, comprising:
- providing a upper and a lower piece of metal,
- positioning the device between said upper and said lower piece of metal,
- positioning the downward facing lip of the device flush against an end section of the lower piece of metal, positioning the upper piece of metal atop the device, positioning a bar into an aperture of the device, pushing the bar away from a user's body, reinserting the bar into an aperture and pushing the bar away from the user's body, and removing the positioning device.

11. A metal positioning device set forth in claim 2, wherein said sidewall is sloped.

12. A metal positioning device set forth in claim 2, wherein said sidewall is stepped.

* * * * *